United States Patent [19]

Goes et al.

[11] 4,393,783

[45] Jul. 19, 1983

[54] FLUIDIC RANGE-SAFE EXPLOSIVE DEVICE

[75] Inventors: Michael J. Goes, Mine Hill; John R. Masly, Landing; Albertus E. Schmidlin, Caldwell, all of N.J.

[73] Assignee: The United States of America as represented by the Secretary of the Army, Washington, D.C.

[21] Appl. No.: 317,049

[22] Filed: Nov. 2, 1981

Related U.S. Application Data

[62] Division of Ser. No. 126,802, Mar. 3, 1980, Pat. No. 4,334,478.

[51] Int. Cl.[3] ..... F42B 9/20

[52] U.S. Cl. ..... 102/529; 102/205; 102/444; 102/495

[58] Field of Search ..... 102/444, 445, 491–498, 102/501, 506, 520–523, 205, 224, 529, 473, 207, 223, 502, 517–519

[56] References Cited

U.S. PATENT DOCUMENTS

| | | | |
|---|---|---|---|
| 37,661 | 2/1863 | Gerardin | 102/495 |
| 3,630,150 | 12/1971 | Rakowsky | 102/205 |
| 3,672,300 | 6/1972 | Axelson et al. | 102/205 |
| 3,854,401 | 12/1974 | Fisher | 102/205 |
| 3,956,993 | 5/1976 | Corrado | 102/205 |
| 3,982,488 | 7/1976 | Rakowsky | 102/205 |
| 3,985,058 | 10/1976 | Corrado et al. | 102/205 |
| 3,994,232 | 11/1976 | Rakowsky | 102/205 |
| 4,080,900 | 3/1978 | Augenstein et al. | 102/495 |
| 4,215,632 | 8/1980 | Sie | 102/521 |
| 4,242,960 | 1/1981 | Boeder et al. | 102/506 |

*Primary Examiner*—Harold J. Tudor
*Attorney, Agent, or Firm*—Robert P. Gibson; Anthony T. Lane; Max Yarmovsky

[57] ABSTRACT

A disintegrable projectile is disclosed which utilizes thermal energy obtained from the conversion of the kinetic energy of the air moving past the projectile to cause its fragmentation. The projectile employs an air intake nozzle axially disposed in the nose portion of the projectile and a resonance tube located in the body portion of the projectile in thermal contact therewith. The resonance tube develops the thermal energy which is transmitted to the body portion to cause the fragmentation thereof. The projectile of the present invention is intended for use in gunnery training and practice conducted within limited size training and practice ranges, where civilian personnel and property may be in proximate location.

3 Claims, 6 Drawing Figures

FIG. 1
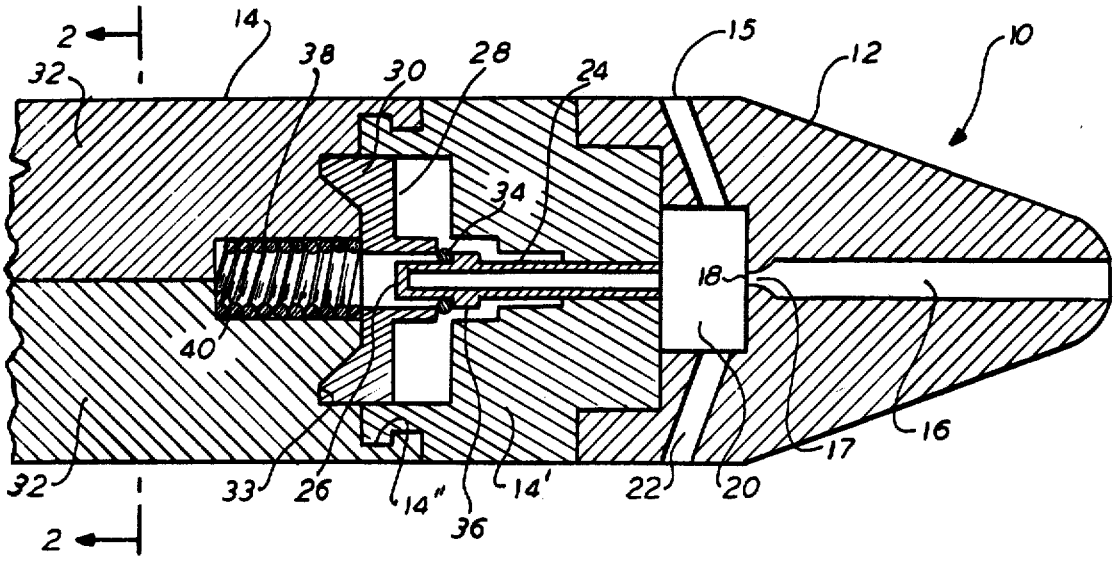
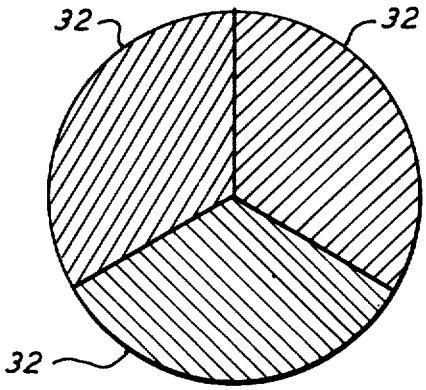
FIG. 2
FIG. 3
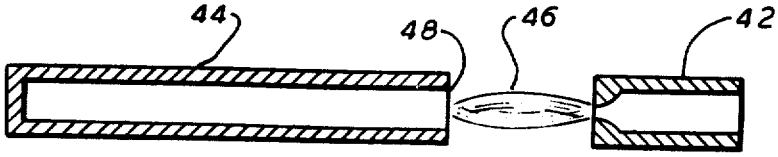

FLUIDIC RANGE-SAFE EXPLOSIVE DEVICE

GOVERNMENT INTEREST

The invention described herein may be manufactured, used and licensed by or for the Government for governmental purposes without the payment to us of any royalty therein.

This application is a division of application Ser. No. 126,802, filed Mar. 3, 1980, now U.S. Pat. No. 4,334,478.

BACKGROUND OF THE INVENTION

The present invention relates generally to explosive projectiles, and particularly to explosive projectiles such as ammunition useful in military training and practice exercises.

In military operations, large explosive projectiles such as those fired from stationary gun emplacements and tanks are still in common use, and military personnel must receive training and maintain proficiency therewith by constant practice. This is particularly important in the instance of mobile armored troop units. Due to the limited sized training ranges encountered in the areas in which armored troop units are deployed, tank gunnery for practice or training has been severely hampered, as it is necessary to provide adequate safety measures to facilitate the involvement of troops, and to secure the safety of adjoining civilian populations. In the past, personnel safety was achieved by limiting the firing to fixed position-fixed target gunnery problems, where the super elevation of the tank gun could be observed and closely controlled.

Recently, increased emphasis has been placed on armored and combined arms operations, resulting in a change in the training doctrine for these types of units. Emphasis has shifted to the simulation of actual tank-to-tank firing. In such new training environment, close control of tank gun super-elevation becomes extremely difficult, and the possibility of a training round exceeding the safety limits of the range and thereby endangering adjacent individuals and property is increased.

Applicants are aware of certain mechanisms known in the prior art as resonance tubes which have displayed some utility in connection with explosive charges, and have accordingly been utilized as explosion initiators. Specifically, U.S. Pat. No. 3,985,058 to Corrado et al, and U.S. Pat. No. 3,994,232 to Rakowsky et al, both assigned to the Assignee of the present invention, disclose explosive initiators or actuators utilizing the conversion of gas movement to thermal energy by means of a device known as a "resonance tube", which comprises a cavity having an open end axially aligned with a suitable high velocity gas flow field. In the instance where instabilities in the impinging flow field are in synchronization with the natural frequency of the gas disposed in the resonance tube, high frequency oscillations are developed which cause the gas in the tube to undergo repeated cycles of periodic compression and expansion. This compression and expansion within the resonance tube produces irreversible temperature increases and develops a significant thermal energy concentrated at the closed end of the tube. See Hartmann, J., "On The Production Of Acoustic Waves By Means Of An Air-Jet Of A Velocity Exceeding That Of Sound", Phil. Mag., No. 7, Vol. 11, 72 pp. 733–749, April, 1931.

SUMMARY OF THE INVENTION

The present invention relates to a projectile useful in gunnery practice which includes a thermally actuated device for causing the disintegration of the projectile after it travels a predetermined distance. The projectile includes a leading nose portion and a generally cylindrical body portion disposed therebehind. The disintegration device includes an air intake nozzle axially disposed in the nose portion which tapers to a reduced diameter nozzle orifice and opens to an air collection chamber having air escape channels radiating regularly therefrom. A temperature transmitter is disposed adjacent the air collection chamber and within the body portion of the projectile, and may comprise a resonance tube. At the opposite end thereof, the temperature transmitter or resonance tube communicates with a fragmentation promoter which permits the disintegration or disassembly of the body portion of the projectile by overcoming the cohesion present in the body portion.

In one embodiment, the fragmentation promoter comprises a disengageable mechanical retainer which secures the body portion of the projectile intact, but is adapted to move out of gripping engagement with the body portion to permit it to disassemble or fall apart. In an alternate embodiment, the fragmentation promoter includes a thermally activated explosive charge which may independently cause the disintegration of the body portion, or may by its detonation, cause a mechanical retainer to release, and permit the body portion to fall apart.

An object of the present invention is to provide a projectile for military gunnery training and practice.

Another object of the present invention is to provide a projectile as aforesaid which is adapted to disintegrate or fall apart after traveling a predetermined distance.

Another object of the present invention is to provide a projectile as aforesaid which converts the kinetic energy of the air moving past the projectile into thermal energy to promote the disintegration of the projectile.

A further object of the present invention is to provide a projectile as aforesaid which utilizes thermal energy to cause the projectile to fall apart.

A further object of the present invention is to provide a projectile as aforesaid which utilizes thermal energy to cause the projectile to be explosively destroyed.

For a better understanding of the present invention, together with other and further objects thereof, reference is made to the following descriptions taken in connection with the accompanying drawings.

BRIEF DESCRIPTION OF THE DRAWINGS

FIG. 1 is a longitudinal cross-sectional fragmentary view of a projectile in accordance with the present invention.

FIG. 2 is a cross-sectional view of the projectile of FIG. 1 taken along lines 2—2 and transverse to the view of FIG. 1.

FIG. 3 is a cross-sectional schematic view illustrating the basic operation of a temperature transmitter useful in accordance with the present invention.

DETAILED DESCRIPTION OF THE PREFERRED EMBODIMENT

Figure 4:
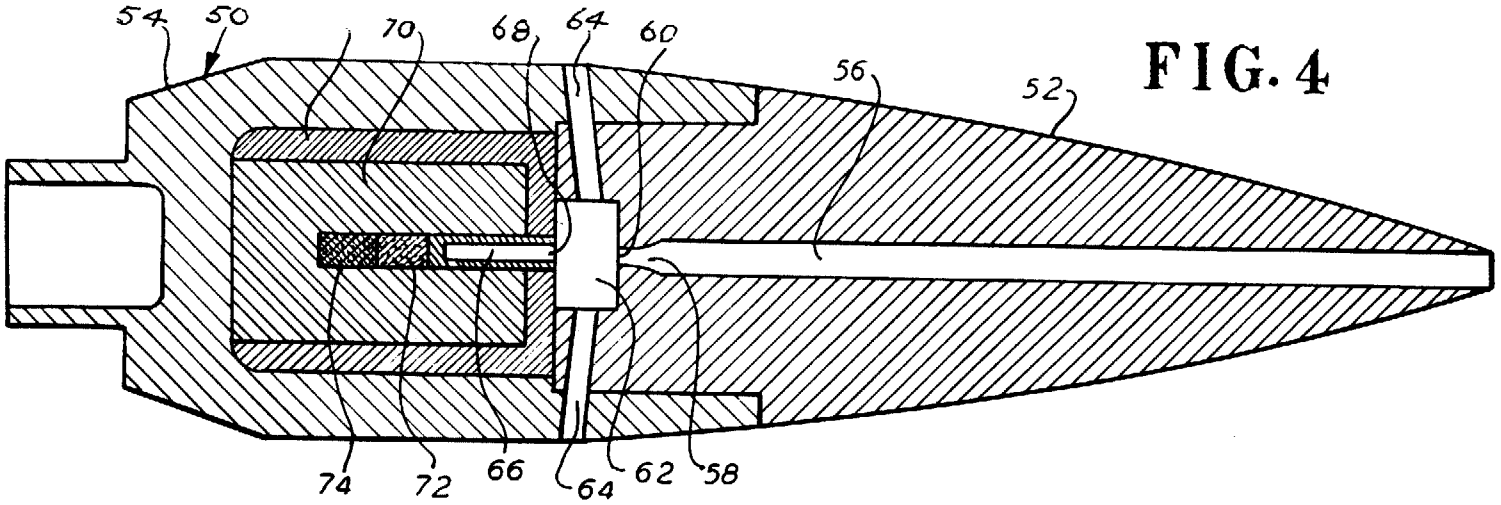
FIG. 4 is a longitudinal cross-sectional view of an alternate embodiment of the present invention.

FIGS. 1 and 2 illustrate a disintegrable projectile which comprises a forwardly located nose portion 12 and a generally cylindrical body portion 14 disposed therebehind. A means for the disintegration of projectile 10 comprises an air intake or gas passageway 16 axially disposed within nose portion 12 which gradually tapers at the rearmost end thereof to a nozzle 17 having a reduced diameter nozzle orifice 18. Nozzle orifice 18 opens into an air collection chamber 20 which communicates with air escape channels 22 which may radiate regularly therefrom. Air collection chamber 20 is, in turn, in fluid registry with a temperature transmitter which may be axially disposed within body portion 14. In the present illustration, the temperature transmitter comprises a generally cylindrical thermally absorptive tube 24, such as a "resonance tube", which is capable of converting cyclical increases and decreases in air pressure into thermal energy which may then be stored at the sealed end 26 thereof. The operation of the resonance tube in combination with the nozzle and air collection chamber, collectively known in the art as a "pneumatic match", will be discussed in greater detail later on.

Continuing further with FIG. 1, tube 24 is, in turn, in contact with a fragmentation promoter assembly which resides in releasable engagement with the body portion 14. The promoter assembly as illustrated in FIG. 1 comprises a spring loaded retaining collar 28 which employs a protruding rim or ring 30 which secures the adjacent longitudinal segments 32 of body portion 14 in contact adjacent each other. Referring briefly to FIG. 2, segments 32 as illustrated may be radially divided into equal arcuate sections determined in relation to the cross-sectional configuration of body portion 14.

Referring further to FIG. 1, the fragmentation promoter of the present invention including retaining collar 28 imbeds in one end of segments 32 within a track 33 adapted to accept extended rim 30. As constructed, tube 24 urges retaining collar 28 into engagement as shown, by means of a thermally sensitive ring 34 which makes frictional contact between the leading edge of collar 28 and the increased diameter stepped surface 36.

The force exerted by the action of axially disposed coil spring 38 located within a cylindrical recess 40 is opposed by the thermally sensitive ring 34 acting against both the increased diameter stepped surface 36 of the tube 24 and the retaining collar 28.

Referring now to FIG. 3, the device, known as a "pneumatic match" is illustrated schematically. The pneumatic match, which serves to convert flow energy into thermal energy, consists of two essential component parts, comprising an excitation nozzle 42 and a resonance tube 44 disposed with its open end adjacent nozzle 42 and in the compression region of a free jet of air simulated by lines 46 as emanating from nozzle 42. When the flow of air emerges from nozzle 42, it accelerates to supersonic speed, and then re-adjusts to subsonic speed by compression through a shock wave. This process creates a series of diamond-shaped cells of alternate supersonic and subsonic flow with regions of instability existing between the different flows. Thus, when the open end 48 of resonance tube 44 is placed in the position as illustrated in a region of instability created by the flow emanating from nozzle 42, a self-sustaining system of oscillations or resonance is developed within the cavity of tube 44, and the gas trapped within the cavity undergoes repeated compression and rarefraction, and produces an irreversible temperature increase several times the initial adiabatic temperature head. The thermal energy thus generated is concentrated at the closed end of the cavity defined by the resonance tube, and may be utilized to initiate processes requiring an input of thermal energy. The foregoing comprises the resonance tube phenomenon as set forth in the Hartmann article, discussed earlier.

As noted earlier, the projectile of the present invention is adapted to disintegrate or disassemble by both mechanical and chemical means. As illustrated in FIGS. 1 and 2, a purely mechanical means of disassembly may be employed which relies on thermal excitation for its operation. In another embodiment, illustrated in FIG. 4, the projectile of the present invention may employ a fragmentation promoter which comprises an explosive charge situated to cause the complete disintegration of the body portion upon activation by the temperature transmitter. Referring in detail to FIG. 4, projectile 50 which disintegrates by explosion, comprises a forwardly disposed nose portion 52 and a rearwardly disposed body portion 54. Nose portion 52 has defined therein an extended tubular gas passageway 56 terminating an intake nozzle 58 which, in turn, tapers to a nozzle orifice 60. As with the projectile of FIG. 1, nozzle orifice 60 communicates with an adjacent air collection chamber or jet chamber 62 which is provided with vents or escape channels 64 radiating therefrom. Similarly, chamber 62 communicates with a temperature transmitter comprising resonance tube 66 so that air jets impinge on opening 68 thereof.

Resonance tube 66 is disposed in contact with a fragmentation promoter assembly which, in the present illustration, comprises an explosive charge disposed within a casing or container 70. In particular, casing 70 defines a closed end which abuts chamber 62 and defines therein an opening for the protrusion of opening 68 of resonance tube 66. Resonance tube 66 as shown is axially disposed within casing 70 and comprises a simple cylindrical tube closed at one end. At the closed end thereof, resonance tube 66 communicates with a fragmentation promoter assembly which comprises a series of explosive charges. In particular, a first initiating charge 72 is disposed in axial abutment with the enclosed end of resonance tube 66. Initiating charge 72 is thermally excited by the transfer of thermal energy from resonance tube 66. In turn, initiating charge 72 at the opposite end thereof is in axial alignment and abutment with a transfer charge 74 which derives its detonation from the detonation of initiating charge 72, and together therewith causes the primary body portion explosive charge 76, surrounding charges 72, 74 and the majority of the length of resonance tube 66, to detonate and thereby cause the fragmentation of body portion 54 and the resulting destruction of projectile 50.

The foregoing fragmentation promoter assembly operates by an essentially chemical reaction requiring thermal actuation that simply destroys the projectile. This is distinguishable from the mechanical disassembly which occurs in the operation of the fragmentation promoter assembly disclosed and illustrated with reference to FIG. 1, earlier.

Figure 6:
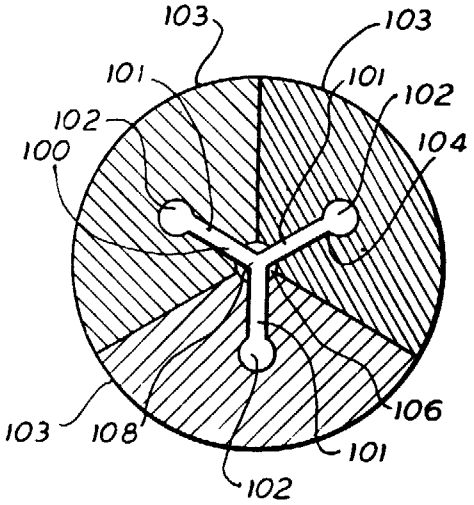
FIG. 6 is a transverse cross-sectional view of the projectile of FIG. 5 taken through line 6—6 thereof.
Figure 5:
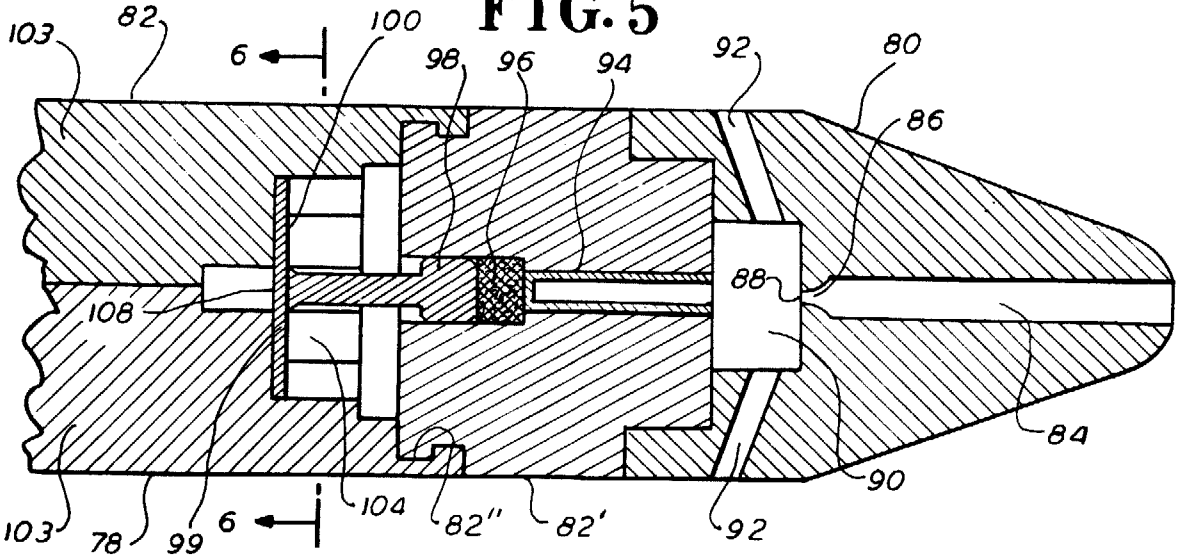
FIG. 5 is a longitudinal cross-sectional fragmentary view of a projectile comprising an alternate embodiment of the present invention.

A further alternate embodiment of the present invention is illustrated in FIGS. 5 and 6, wherein a projectile of the present invention utilizes a fragmentation promoter assembly relying on a combination of explosive detonation and mechanical disassembly. Referring to FIG. 5, projectile 78 is illustrated fragmentarily and comprises nose portion 80 and body portion 82. Nose portion 80 contains therein gas passageway 84, which leads to nozzle 86, which, in turn, terminates in nozzle orifice 88. As with the previously described embodiments, nozzle orifice 88 opens into air collection chamber or jet chamber 90, that is provided with radially extending vents or escape channels 92. Similarly, resonance tube 94 is disposed in axially alignment with nozzle 86 and in abutment with chamber 90 to receive and transmit the thermal energy generated by the impinging air jets.

The present projectile differs in the employment of a variant fragmentation promoter assembly. Specifically, an initiating charge 96 is disposed in axial abutment with the closed end of resonance tube 94. Charge 96, in turn, at the opposite axial end thereof, abuts a generally cylindrical cutter ram 98. Cutter ram 98 as assembled within body portion 82 is disposed adjacent a retainer or spider 100. Referring now to FIG. 6, spider 100 defines radiating arms 101 that are adapted to anchor at free distal ends 102 within respective longitudinal body segments 103. Body segments 103 are generally similar to body segments 32, in FIG. 1. Distal ends 102 may be enlarged as illustrated in FIG. 6 to prevent release from body segments 103. Arms 101 are joined at the opposite ends thereof and form a radially extending spider bore 104 to house spider 100, including a central axially extended central cylinder 106, that as shown in FIG. 6 is greater in diameter than connective area 108 of spider 100.

Referring again to FIGS. 5 and 6, cutting head 99 abuts connective area 108 and presents a broader leading surface approximating in area the cross-sectional area of central cylinder 106, provided for the reception of head 99. Thus, when charge 96 is detonated, the force of the explosion thrusts cutter ram 98 forward against spider 100 so that cutting head 99 severs connective area 108 from the remainder of spider 100. As the projectile 78 is spinning in flight, the centrifugal force causes the segments 103 thus released to move radially outward and away from each other, and to separate from nose portion 80 and the projectile base not shown herein, to prevent the projectile 78 from traveling further forward.

Referring to FIGS. 1 and 5, the projectiles employing a mechanical means of fragmentation promotion, rely on a transversely segmented body portion. Referring to FIG. 1, body portion 14 includes forward body portion 14' that snapfittably engages the remainder of body portion 14, comprised of segments 32 by a tongue-in-groove joint 14". In similar fashion, the projectile of FIG. 5 employs a tongue-in-groove joint 82" to connect forward body portion 82' with the rearward body portion defined by segments 103. In this way, the release or destruction of the element retaining the respective longitudinal segments intact, permits the segments to fall away due to centrifugal force generated by the spin of the projectile in flight, and results in an early and safe termination of the projectile's trajectory.

The projectiles of the present invention may be constructed from those materials conventionally employed in the munitions art. For example, most of the components which contribute to the structural integrity of the projectile may be fashioned from common metals such as steels which are capable of retaining their structural integrity under "firing" conditions. Such components would include the outer casings for the projectile, and the retainer employed in the projectile of FIG. 1.

Those components of the projectile that function by undergoing shear or fragmentation in use may be prepared from lighter weight, more ductile materials, such as aluminum and the like, while those components which must exhibit a capacity for thermal absorption and conductance, may be fashioned from appropriate materials offering such properties. The specific materials which may be employed are otherwise known in the art, and the invention is accordingly not limited to a particular type of material.

The foregoing disclosure and drawings are merely illustrative of the principles of this invention and are not to be interpreted in a limiting sense. We wish it to be understood that we do not desire to be limited to the exact details of construction shown and described for obvious modifications will occur to a person skilled in the art.

What is claimed is:

1. Fluidic range safe device which comprises;

a projectile having a leading nose portion and a generally cylindrical body portion located therebehind, said body portion including;

at least two complementary longitudinal segments adjacently disposed to form a cylindrically shaped body assembly, said body assembly having a plurality of cylindrical recesses axially located therein and a tongue-in-groove end;

a cylindrical forward body portion operatively disposed intermediate said longitudinal segments and said nose portion, said forward body portion snapfittably engaging said tongue-in-groove end of said longitudinal segments and to said nose portion;

means for thermally inducing disintegration of said body portion of said projectile further comprising;

a nozzle element axially disposed in said nose portion, said nozzle element tapering to a reduced diameter orifice;

an air vent assembly communicating with said orifice, said air vent assembly comprising an air collection chamber and air escape channels radiating therefrom;

temperature responsive fragmentation means located in said forward body portion in fluid registry with said air vent assembly, said fragmentation means adapted to respond to elevated temperature to cause said body portion to disintegrate which includes;

temperature transmitter means disposed within said body, said temperature transmitter adapted to absorb and transmit thermal energy, said transmitter means includes a temperature absorptive tube having an open end communicating with said air collection chamber, and an opposed closed end; and fragmentation promoter means, disposed in registry with said closed end of said temperature absorptive tube, for overcoming the cohesive forces maintaining the integrity of said body portion; said promoter means includes;

retainer means comprising a spider member for releasably holding said longitudinal segments and said forward body portions together during projectile launch and flight, and for mechanically allowing said longitudinal segments to separate from said forward body portion after said projectile has traveled a specified distance down range; and said release means comprises a movable cutter ram disposed at one end thereof in axial abutment against said retainer, and a thermally actuated explosive charge located between the opposite end of said cutter ram and the closed end of said temperature absorptive tube, whereby the detonation of said explosive charge forces said cutter ram to impinge upon said retainer to cut said retainer and to force said retainer to release said longitudinal segments.

2. The projectile of claim 1 wherein said retainer comprises a spider device having a plurality of arms adapted to grippingly engage a corresponding number of said longitudinal segments, and a central connective portion securing said arms and said segments in abutment adjacent each other, said cutter arm defines at the end thereof in abutment with said retainer, a cutting head having a surface area greater than that of said connective area, said connective area comprising said restraining means, whereby the detonation of said explosive causes said cutting head to sever said connective area from said arms and allows said longitudinal segment to separate from each other.

3. The projectile of claim 2 wherein said arms include enlarged distal ends fixedly disposed within corresponding cavities in each of said body segments.

* * * * *